US005876111A

United States Patent [19]

Wu

[11] Patent Number: 5,876,111

[45] Date of Patent: Mar. 2, 1999

[54] DECORATIVE LIGHTING STRING WITH EXPANDABLE, SHRINKABLE AND THREE-DIMENSIONAL UNIT

[76] Inventor: Jeng-Shyong Wu, No. 14, Alley 1, Lane 326, Shyr-Piin Road, Hsin-Chu City, Taiwan

[21] Appl. No.: 706,296

[22] Filed: Sep. 4, 1996

[51] Int. Cl.[6] ..... F21V 21/14

[52] U.S. Cl. ..... 362/250; 362/252; 362/807; 362/808; 362/809

[58] Field of Search ..... 362/807–809, 362/227, 250, 252, 249

[56] References Cited

U.S. PATENT DOCUMENTS

| | | | |
|---|---|---|---|
| 4,404,621 | 9/1983 | Mauro | 362/252 |
| 4,769,749 | 9/1988 | Felski | 362/252 |
| 5,526,246 | 6/1996 | Liou | 362/252 |
| 5,645,343 | 7/1997 | Rinehimer | 362/252 |
| 5,664,877 | 9/1997 | Wu | 362/252 |

*Primary Examiner*—Carroll B. Dority
*Attorney, Agent, or Firm*—McGlew and Tuttle

[57] ABSTRACT

An expandable and shrinkable decorative lighting string arrangement with a plurality of lamp bulbs, lamp bases, lamp holders, all connected by wires to form a lighting string. The lighting string is connected to a plurality of stands by a clamp. An axis connector forms a support for the ends of the stands, and the ends of the stands are movably connected to the axis connector to form an expandable volume and a shrunken volume. The expandable volume attains a decorative structure with the stands spaced from each other. The shrunken volume positions the stands adjacent to each other. A locking device locks the stands to the axis connector to cause the stands to form the decorative structure.

35 Claims, 23 Drawing Sheets

DECORATIVE LIGHTING STRING WITH EXPANDABLE, SHRINKABLE AND THREE-DIMENSIONAL UNIT

BACKGROUND OF THE INVENTION

The present invention generally relates to an expandable, shrinkable and three-dimensional lighting string unit in a Christmas decorative lighting string and more particularly to the combination structure of the lamp bulb connected in series or in parallel whereby to form a decorative lighting string.

Generally, the decorative lighting string is used around a tree, window or door, or pre-arranged on a decorative sheet or a stand. Such lighting strings are only a simply decorative lighting string. Some of the conventional lighting strings are arranged on a three-dimensional body. All of them are not any variance. Further, the package of these take up a large volume so that the tanspotation and storage are not so easy. Thus, the cost will be increased so as to reduced the customer's purchasing ability.

SUMMARY OF THE INVENTION

The present invention relates to an expandable, shrinkable and three-dimensional lighting string unit comprising multiple lamp bulbs, lamp bases, lamp holders, clamping means, single or multiple axis means. The present invention provides a lighting string unit by adding clamping means fixed on a strand with multiple limbs, and employs an axis means as a axis connecting the stand which brings an expandable and shrinkable lighting string, changing the volume and shape, to form the perfect decorative effect. Further, after shrinkage, the volume becomes small and convenient to package, transport and store. Therefore, the products manufactured according to the present invention will be valuable in comparison with the conventionally decorative lighting string. Thus the present invention provides a structure with high creation and novelty of the decorative lighting string unit.

Other objects and features will become apparent when the description of preferred embodiments is taken in conjunction with the annexed drawings.

BRIEF DESCRIPTION OF THE DRAWINGS

FIG. 8B is showing a shrinkable drawing;

Figure 9B:
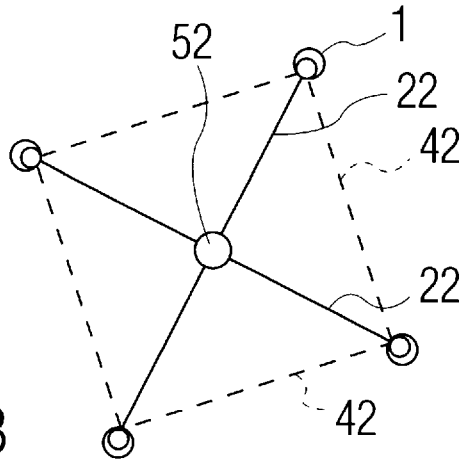
Figure 9A:
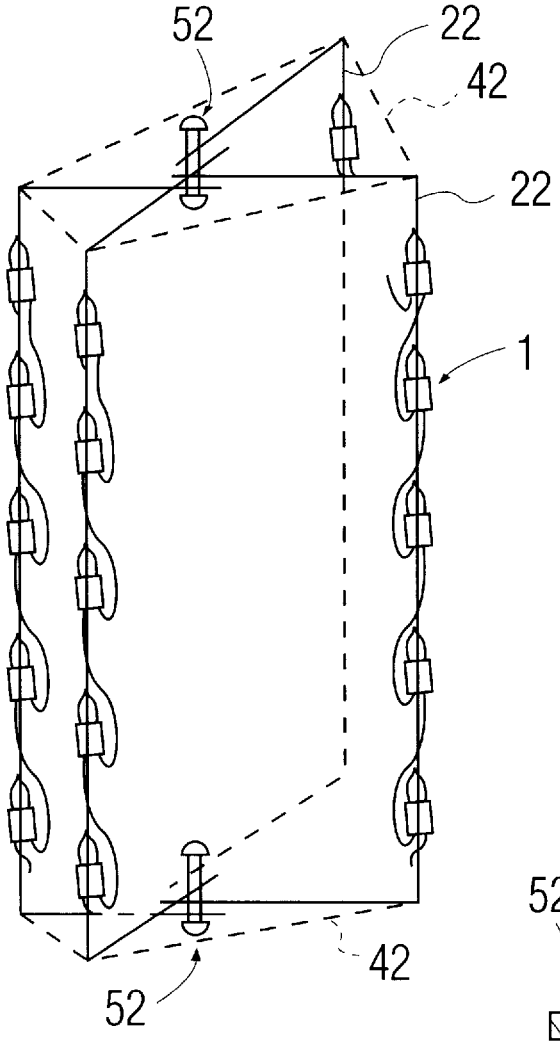
Figure 9C:
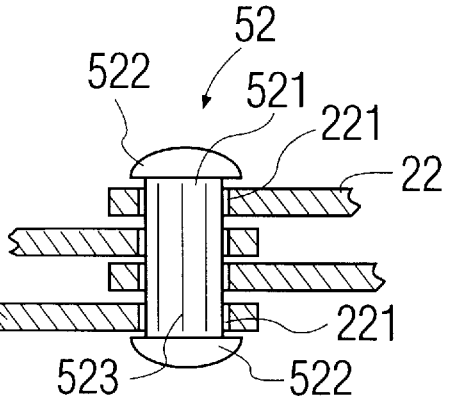
Figure 10:
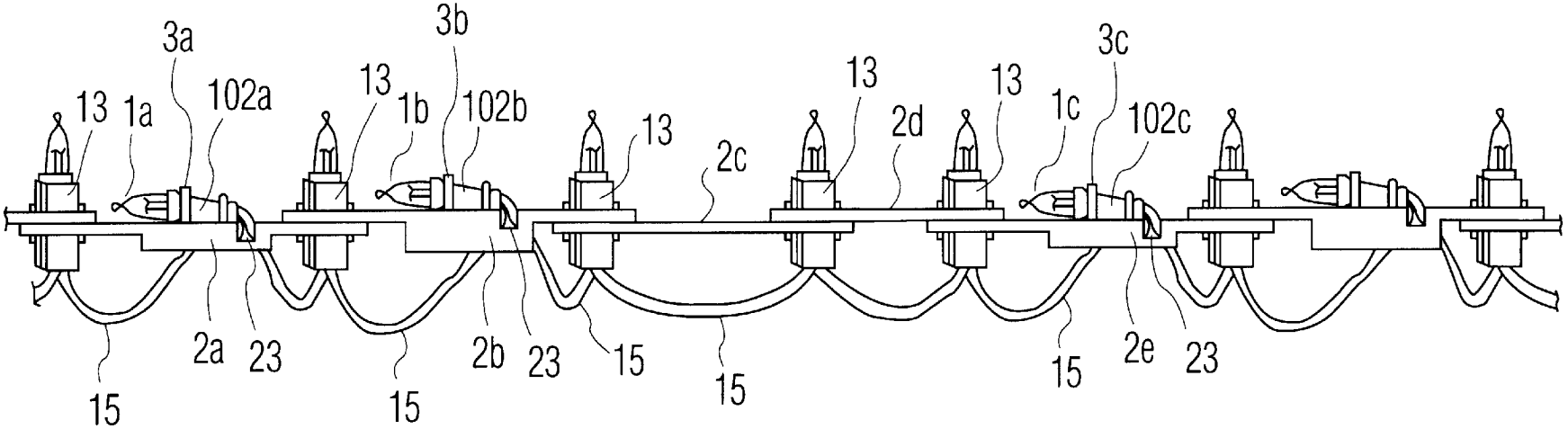
Figure 11A:
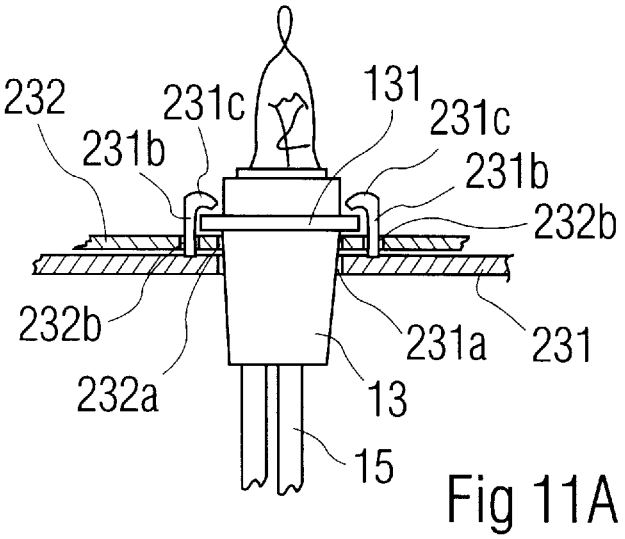
Figure 11B:
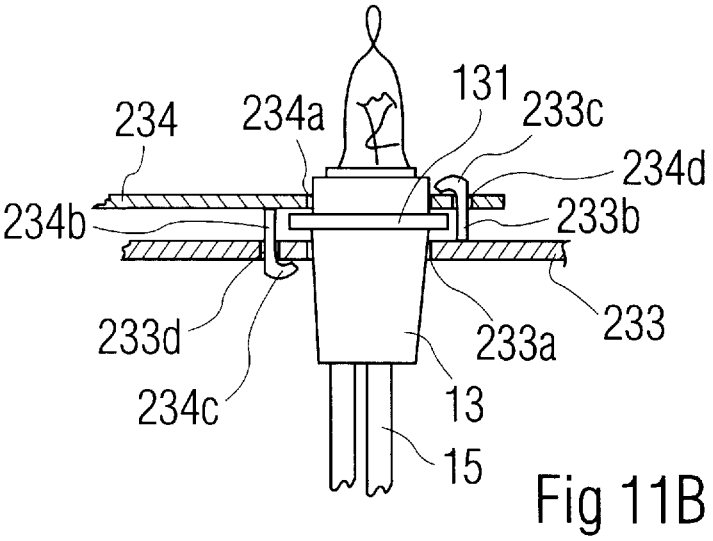
Figure 12B:
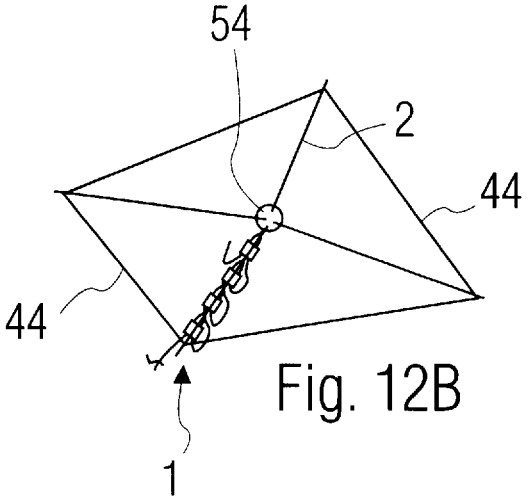
Figure 12D:
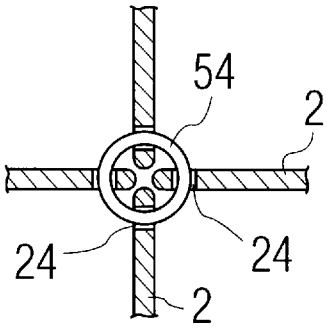
Figure 12A:
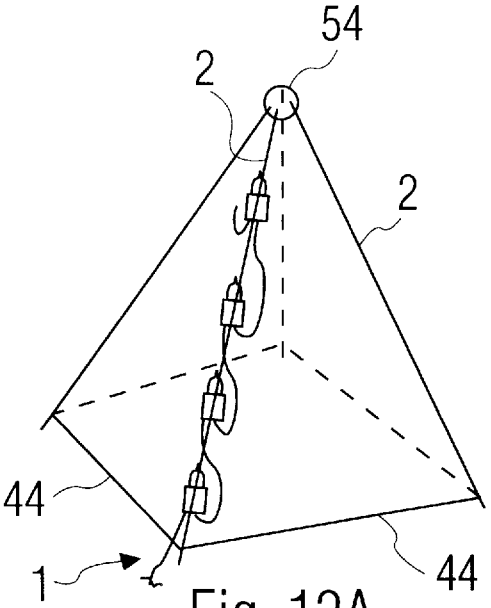
Figure 12C:
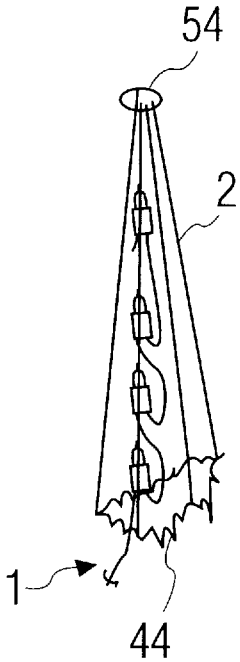
Figure 13B:
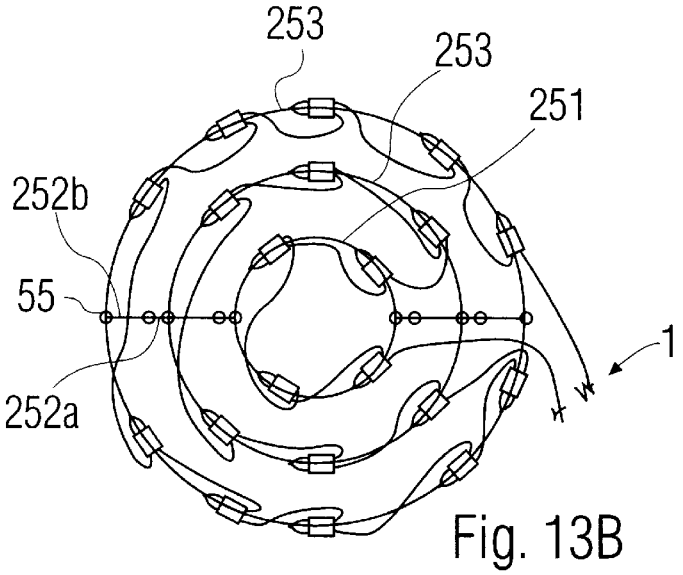
Figure 13A:
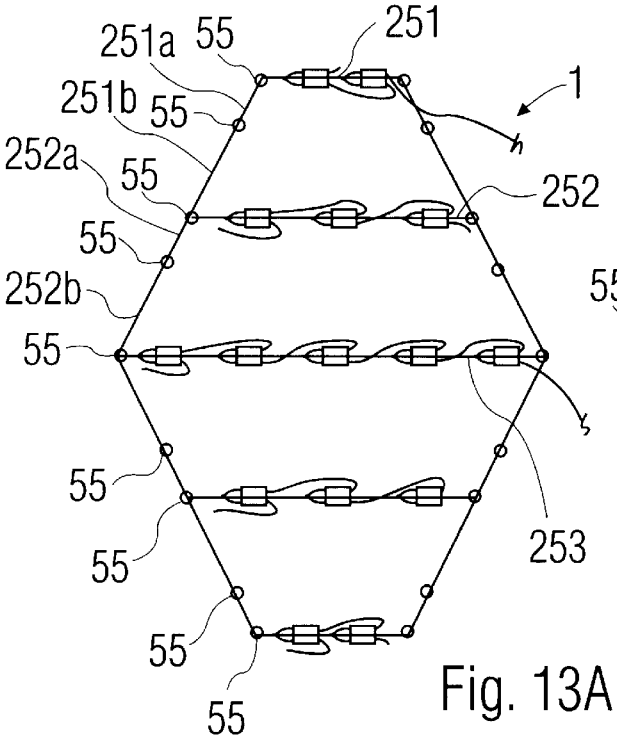
Figure 13C:
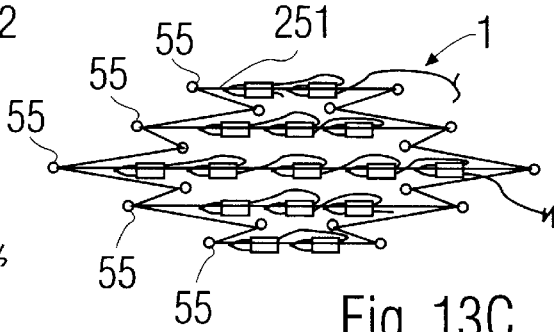
Figure 14B:
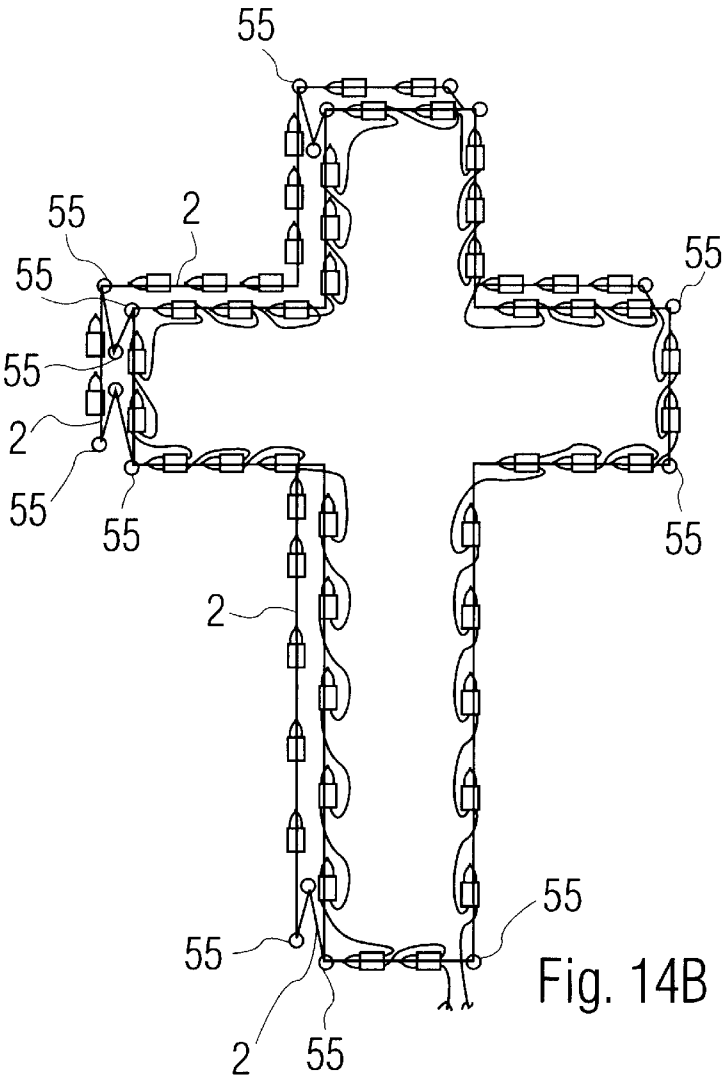
Figure 14A:
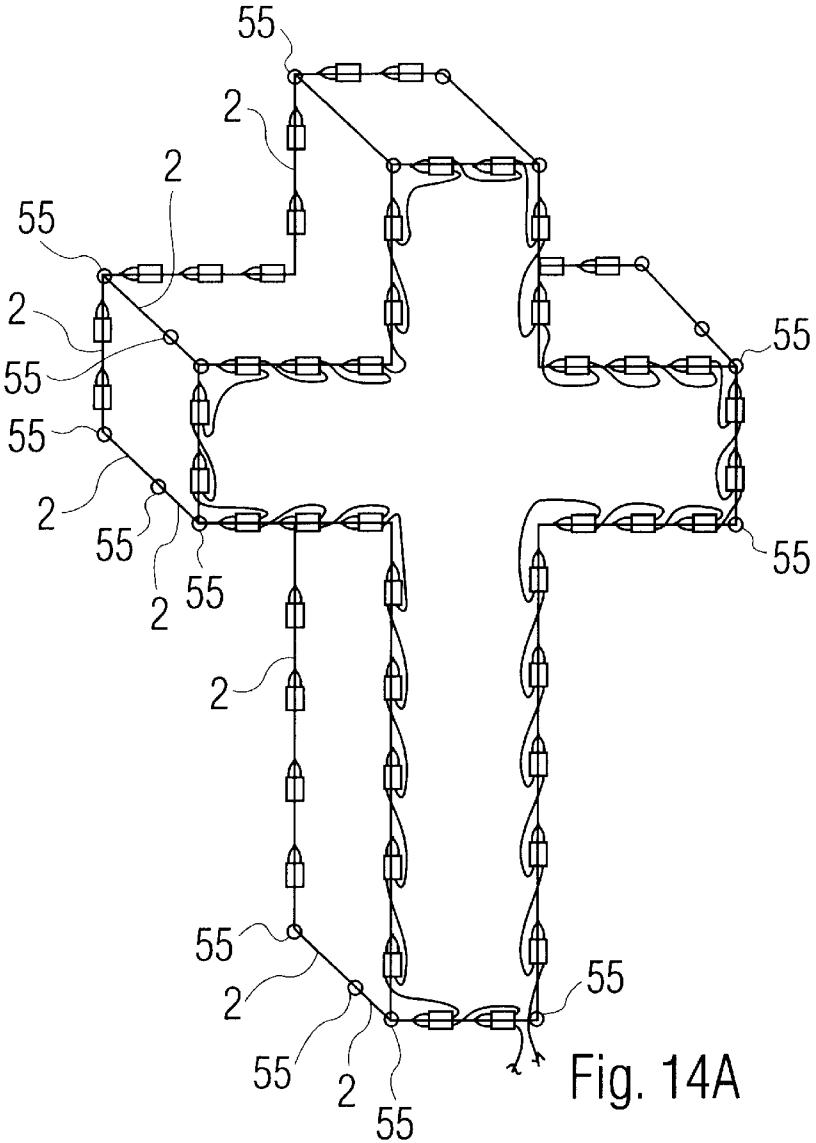
Figure 15B:
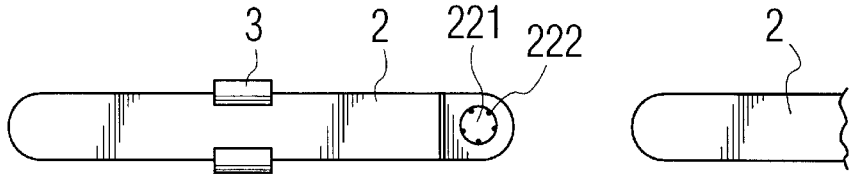
Figure 15A:
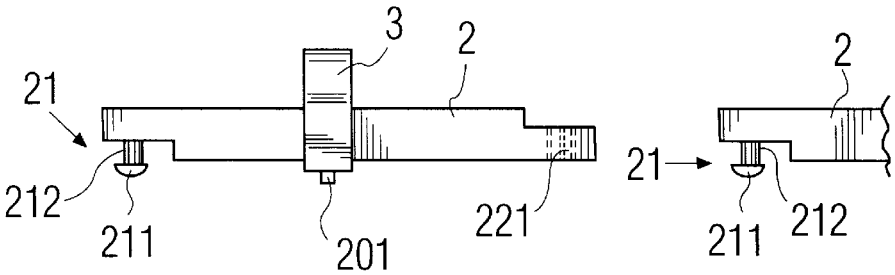
Figure 15D:
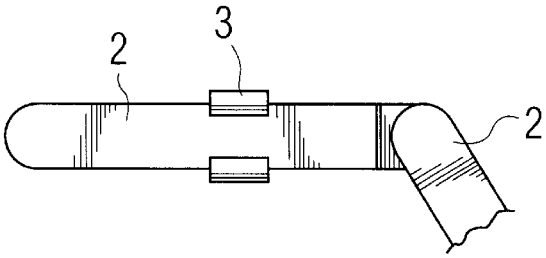
Figure 15C:
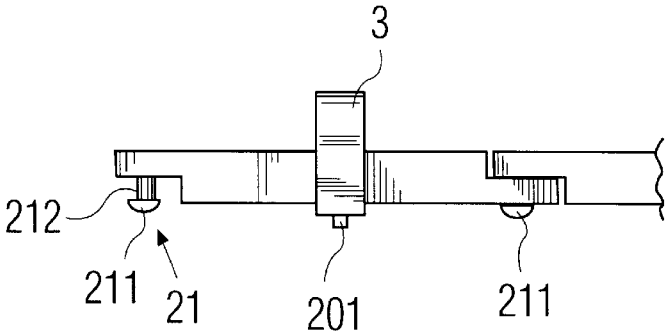
Figure 16:
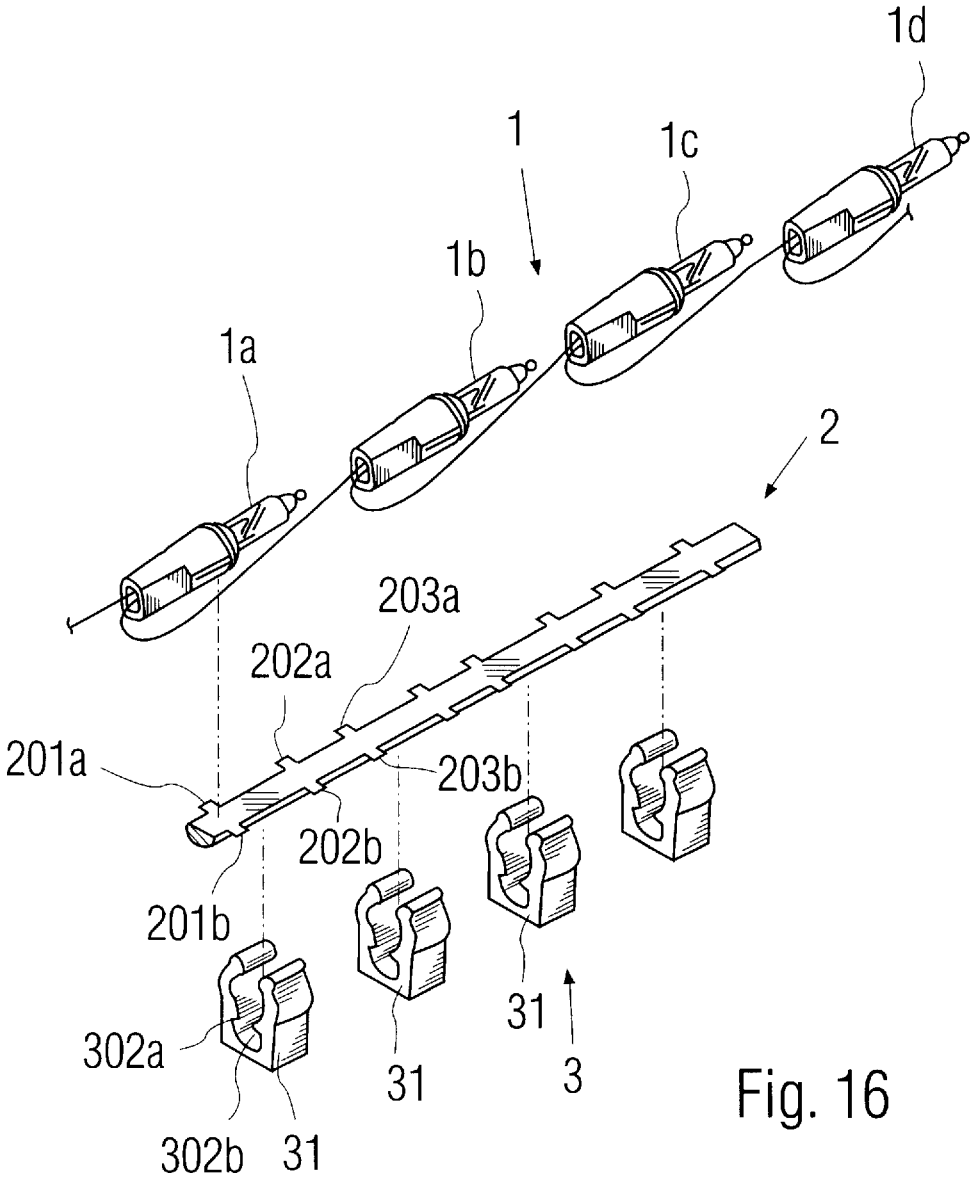
Figure 17:
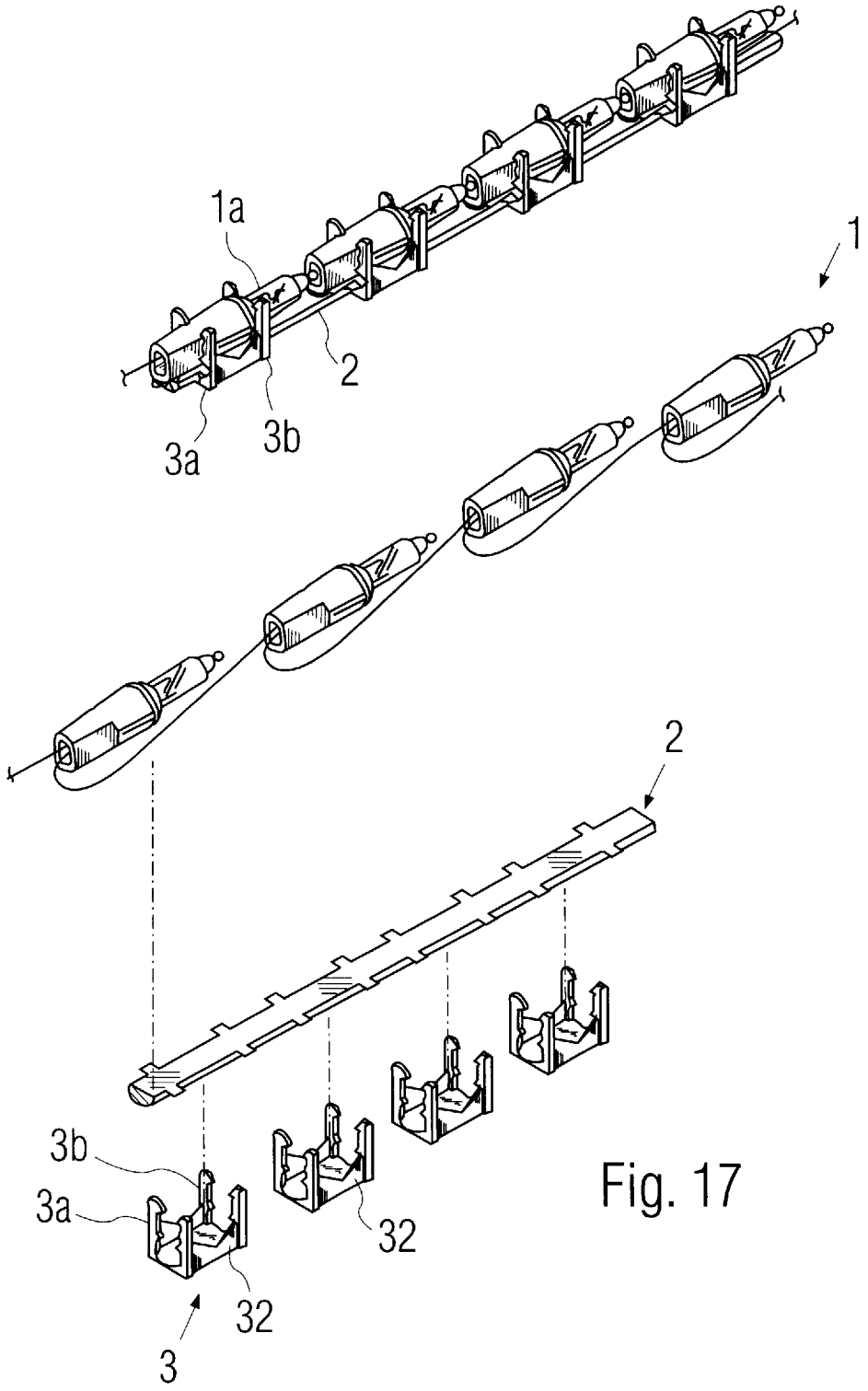
Figure 18:
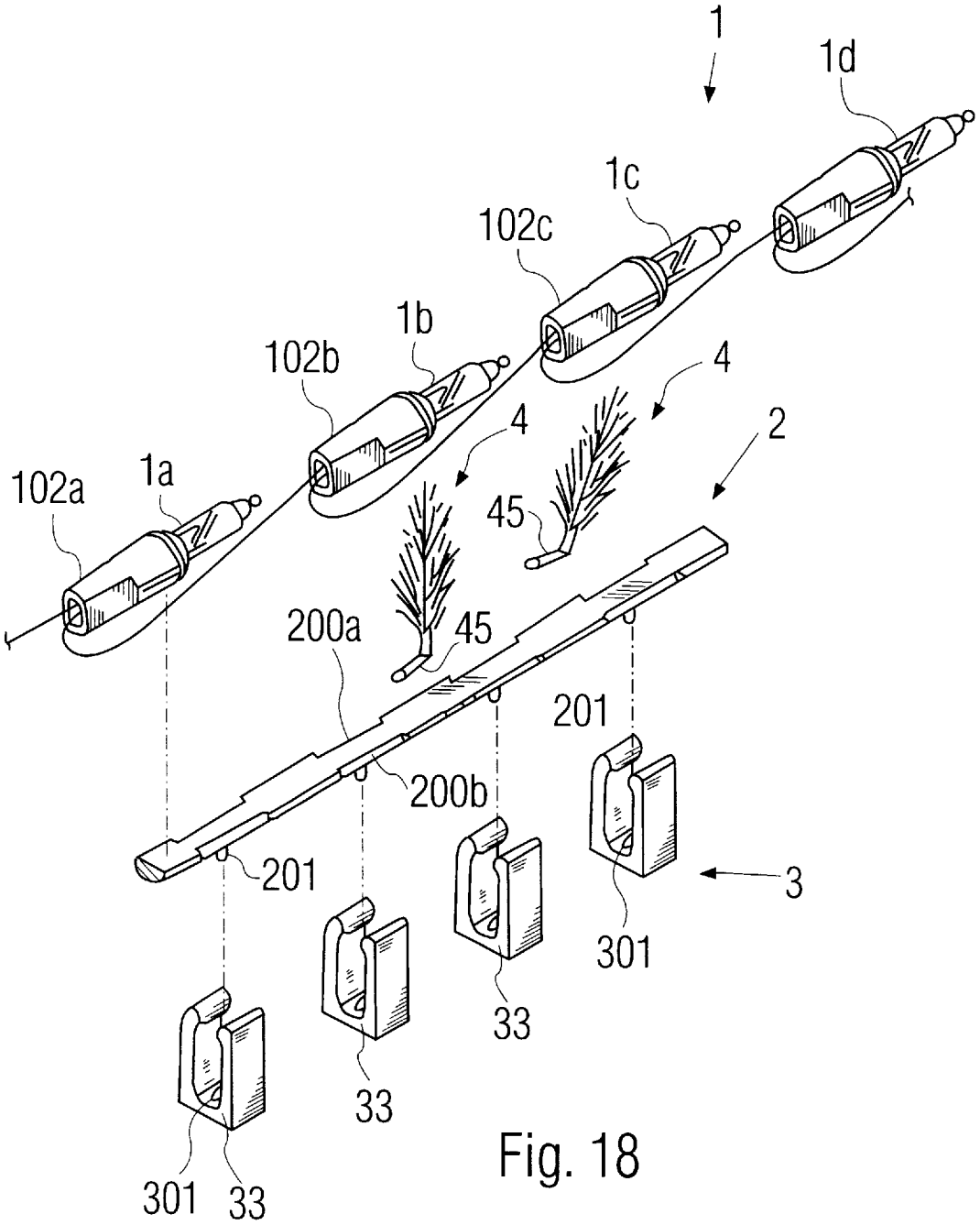
Figure 19:
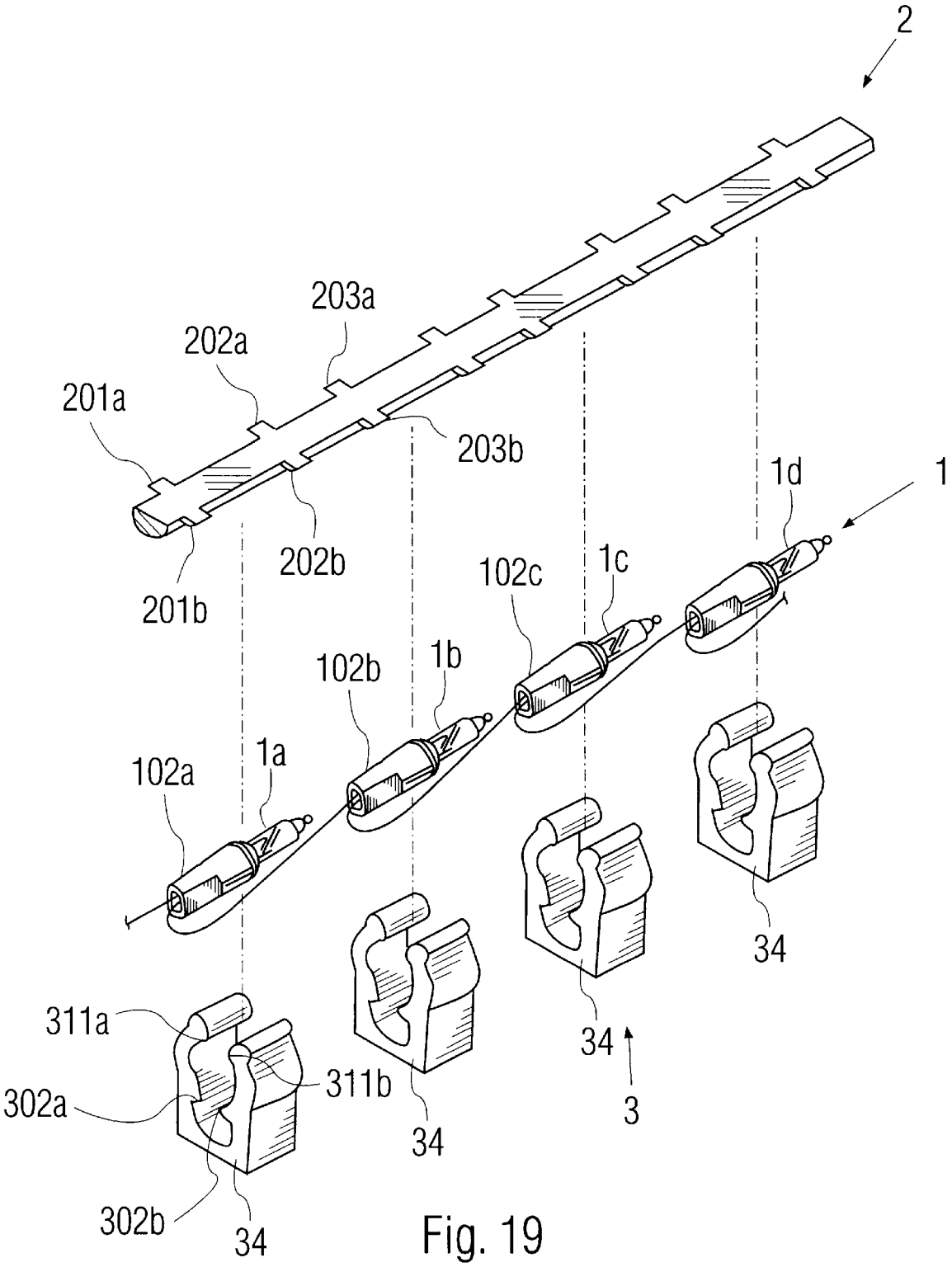
Figure 20A:
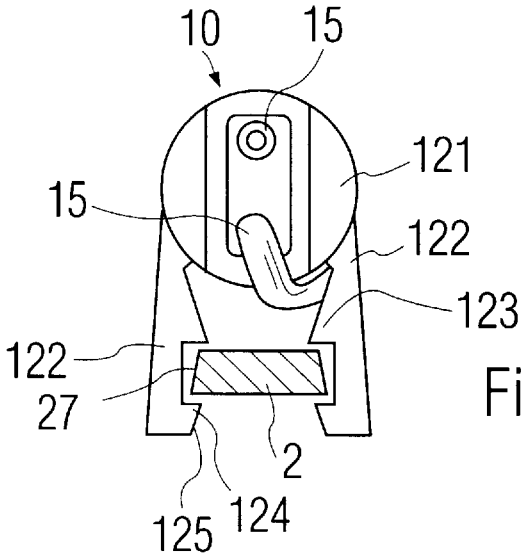
Figure 20B:
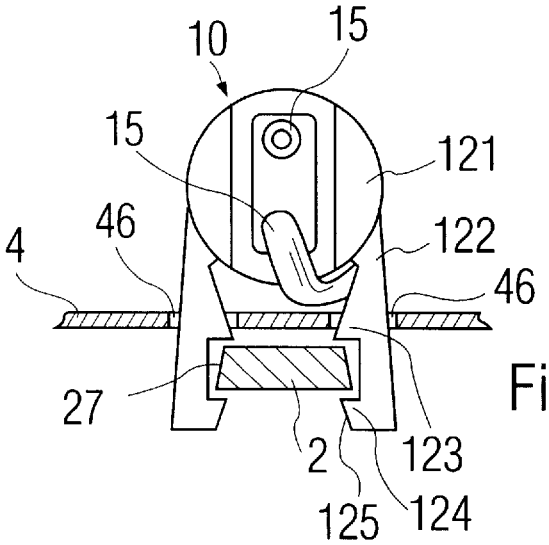
Figure 20C:
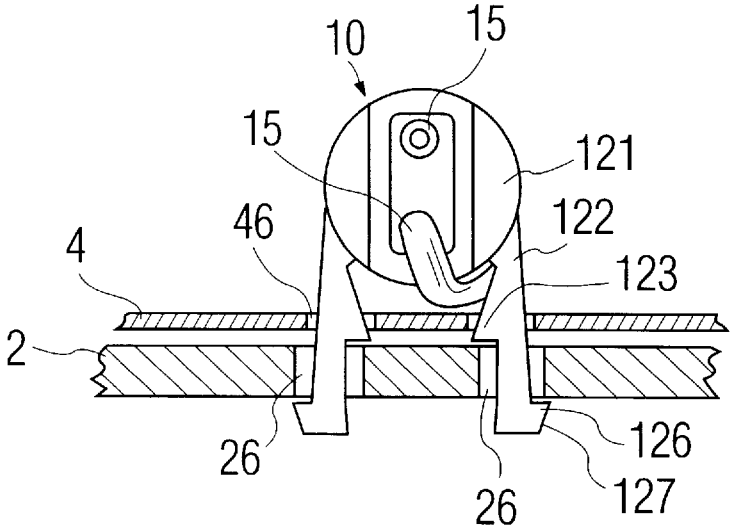
Figure 21A:
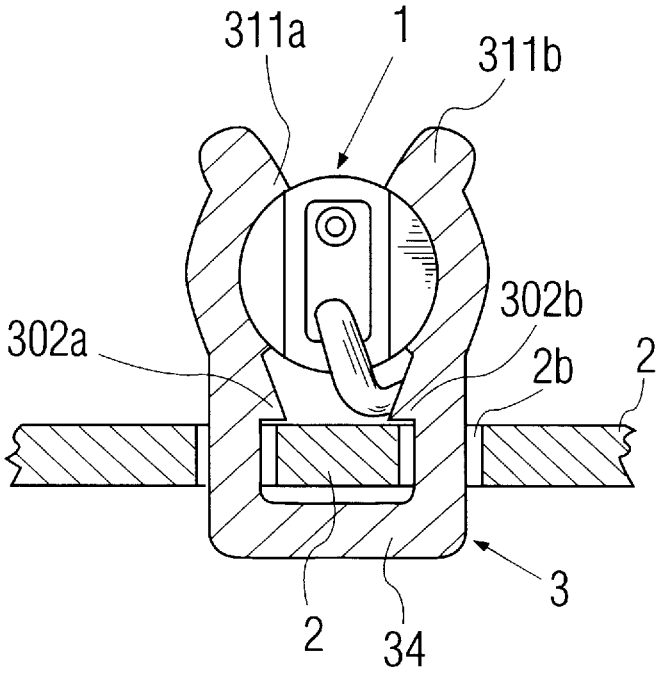
Figure 21B:
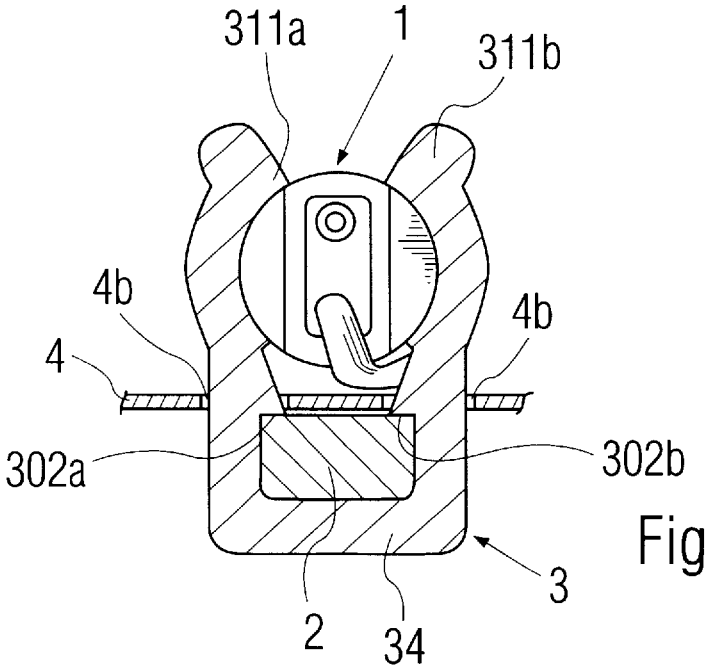
Figure 22A:
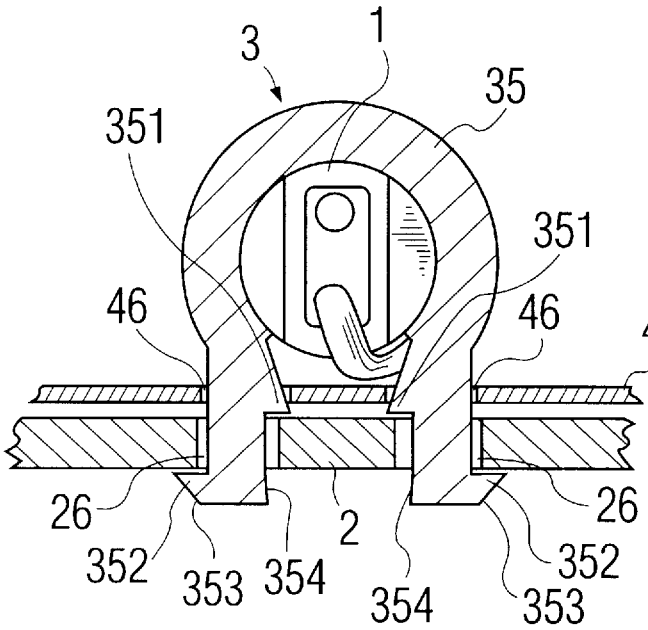
Figure 22B:
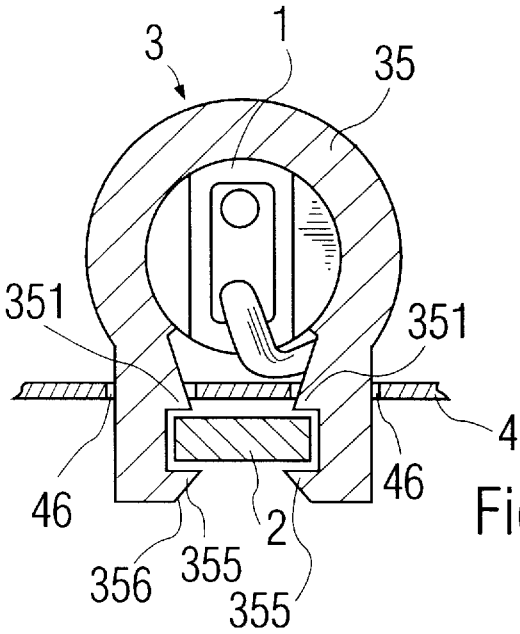
Figure 23B:
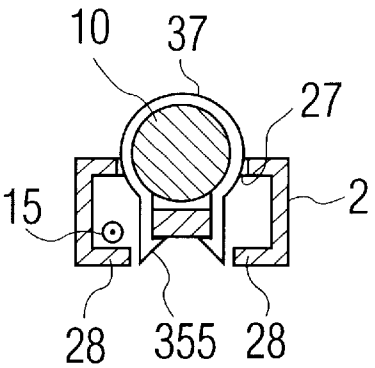
Figure 23C:
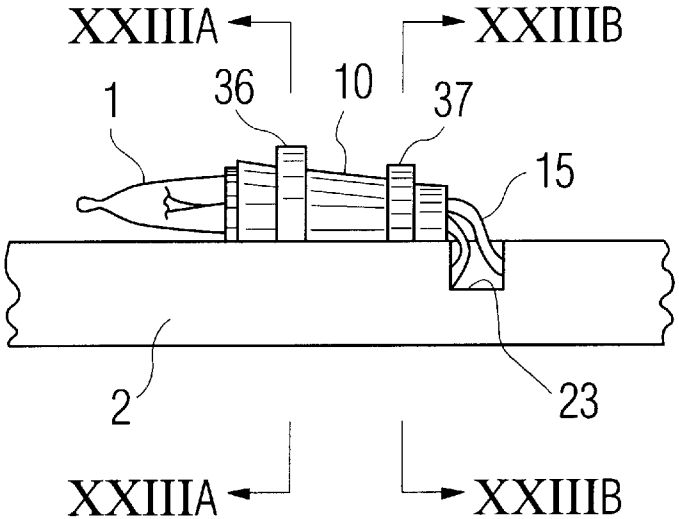
Figure 23A:
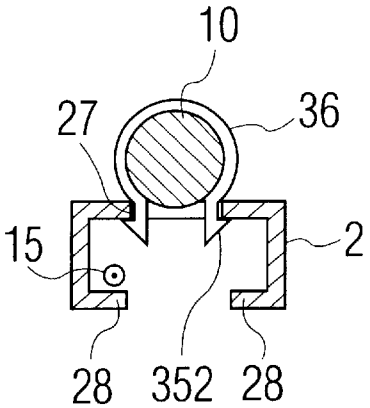

With FIGS. 9A–9C show the axis of the axis mean plate of the decorative lighting string of the present invention, FIG. 9A showing the decorative lighting string of the present invention, with FIG. 9B showing the top view the decorative lighting string of the present invention, and with FIG. 9C showing the cross-section drawing of the combination of the axis and stand;

FIG. 10 show the use of the axis mean holder as the axis of the decorative lighting string of the present invention;

FIGS. 11A and 11B are cross-sectional views showing the use of the axis mean holder as the axis and in combination with the stand of the decorative lighting string of the present invention;

FIGS. 12A–12D show a pyramid type to use the axis mean ring as the axis of the decorative lighting string of the present invention, wherein FIG. 12A is an expandable drawing of pyramid, FIG. 12B is the top view of the expandable drawing of pyramid, FIG. 12C is a shrinkable drawing of pyramid, and FIG. 12D is the cross-section drawing of the combination of ring and stand;

FIGS. 13A–13B show a lantern type to use the axis mean material and the combination of the support and hole of the stand, FIG. 13A is an expandable drawing, FIG. 13B is the top view, and FIG. 13C is a shrinkable drawing;

FIGS. 14A and 14B show the Cross type to use the axis mean material, wherein FIG. 14A is an expandable drawing, FIG. 14B is a shrinkable drawing;

FIGS. 15A–15D show the use of the axis mean material and the combination of the support and hole of the stand, wherein FIG. 15A is not yet combined (exploded) FIG. 15B is the top view of FIG. 15A, FIG. 15C is a drawing after combination, and FIG. 15D is the top view of FIG. 15C;

FIG. 16 is a perspective view of the assemblies of lighting string, stand and clamping means;

FIG. 17 is a perspective view of a further embodiment of the assemblies of lighting string, stand and clamping means;

FIG. 18 is a perspective view of a further embodiment of the assemblies of lighting string, stand and clamping means;

FIG. 19 is a perspective view of a further embodiment of the assemblies of lighting string, stand and clamping means;

FIGS. 20A–20C are cross-sectional views of the assemblies of lighting string, stand, clamping means and decorative material;

FIGS. 21A and 21B are a cross-sectional views of a further embodiment of the assemblies of lighting string, stand, clamping means and decorative material;

FIGS. 22A and 22B are cross-sectional views of a further embodiment of the assemblies of lighting string, stand, clamping means and decorative material; and FIG. 23 is a cross-section drawing of a further embodiment of the assemblies of lighting string, stand, clamping means and decorative material, FIG. 23A is a cross-section drawing of FIG. 23 A—A line, FIG. 23B is a cross-section drawing of FIG. 23 B—B line.

DESCRIPTION OF PREFERRED EMBODIMENTS

The present invention relates to a structure of decorative lighting string and consists of several lamp bulbs, lamp base, lamp holder which connected by electrical wires into string, several stands, several clamping means, and one or several axis means. Said clamping means have different kinds of structure, such as: from base extending to several clamping locations comprising single U type, several U type; from lamp holder extending sideways to several clamping feet so as to support the stand and decorative material. Various clamping methods are used such as: to clamp or connect the lamp holder first, then to clamp the stand, or to clamp the stand first, then to clamp the lamp holder. The stands are also various in accordance with the necessity of connection, such as: half circle, straight sheet, polygon or pillar, flat, etc, then to use the axis means to connect the stand. The axis means are varieties too, such as: axis plate, the lamp holder used as axis, axis ring or the combination of the pillar or hole which extended from the stand used as the axis. After the axis means is connected to the stand, said axis means can be used as a center, each of the stands are able to change their position or their direction to make an expandable or shrinkable, to change their volume or pattern so as to obtain a kind of decorative structure of multiple effects, functions and varieties.

Further, the present invention can be expandable and shrinkable. When the decorative lighting string of present invention is used, it expands to form a large and three-dimensional structure of a pretty decorative lighting string. When in non-use, it can be received within flat and small volume for the convenience of package, transportation and storage. Thus the products produced according to the present invention are able to provide a highly economic and effective device.

Figure 1:
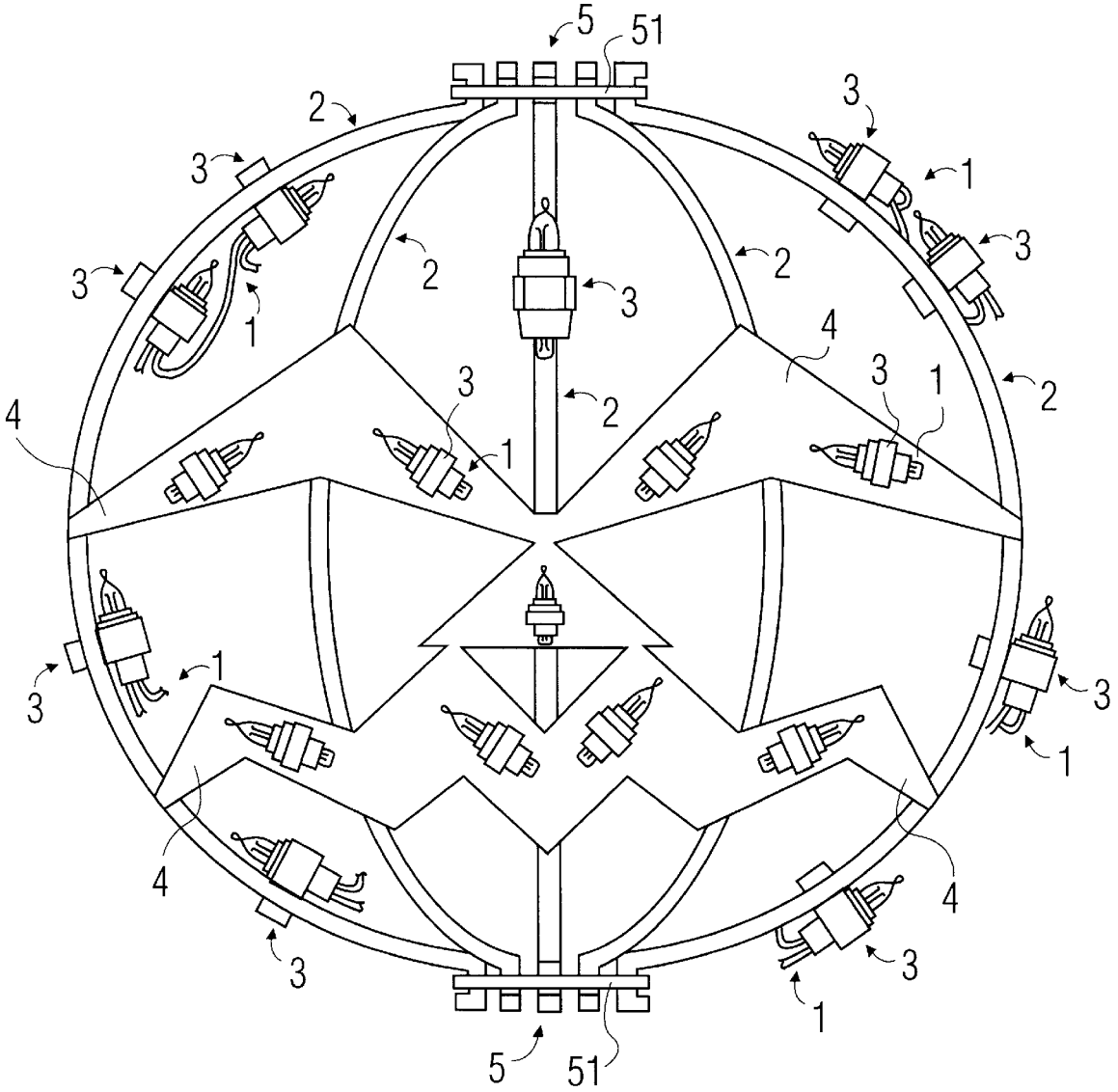
FIG. 1 is showing an expandable and shrinkable pumpkin type of the decorative lighting string of the present invention.

The present invention provides the different combination among the assemblies. Such combination is suitable to the different usage, places, decorative types and effects. In order to understand the present invention completely, the descriptions are done for the preferred embodiments shown in the drawings:

Now referring to FIG. 1, this drawing shows an expandable and shrinkable pumpkin type of the decorative lighting string of the present invention to depict of the first embodiment of the combination of the assemblies. The lighting string comprises the lamp bulb, lamp base or lamp holder formed by the connection of the electric wires. A clamping mean 3 is to clamp and fix the lighting string 1 on a stand 2. Said stand is a half circle. The both ends of stand are connected and fixed on axis plate 51 of axis means 5. A decorative sheet 4 formed the eyes, nose and mouth of pumpkin fixed on the stands. Further, said decorative sheet 4 clamps the lighting string 1. Both ends of all stands use the axis plate 51 as the center. Said stands can be expandable and shrinkable. When expanding, it shows as the decorative lighting string of pumpkin type. When the stands being shrunk, the structure becomes flat type and the volume is small down. If it is re-used, only to expand the stands to original position and fixed them.

Figure 2:
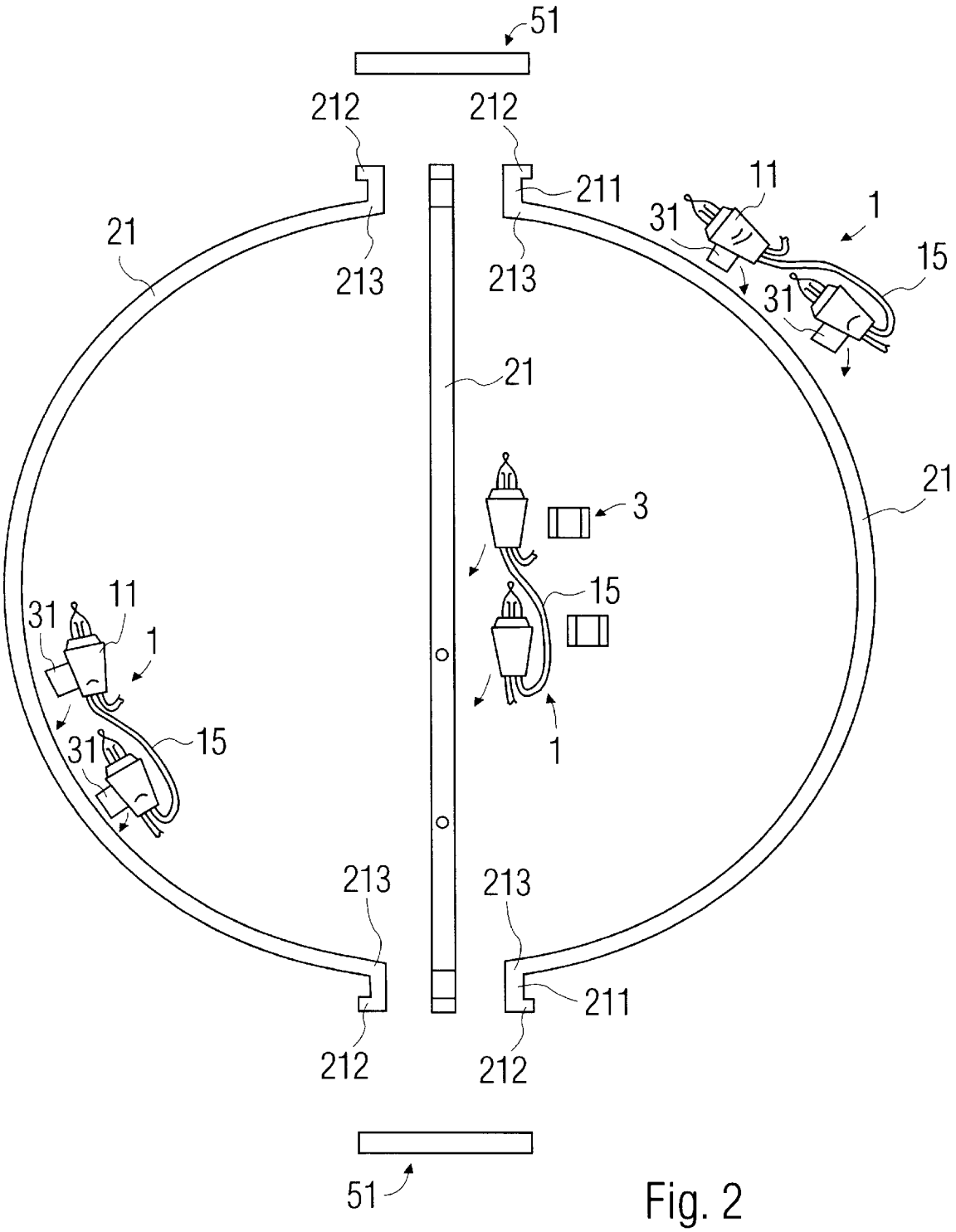
FIG. 2 is showing an exploded view of an expandable and shrinkable circle type of the decorative lighting string of the present invention.
Figure 3:
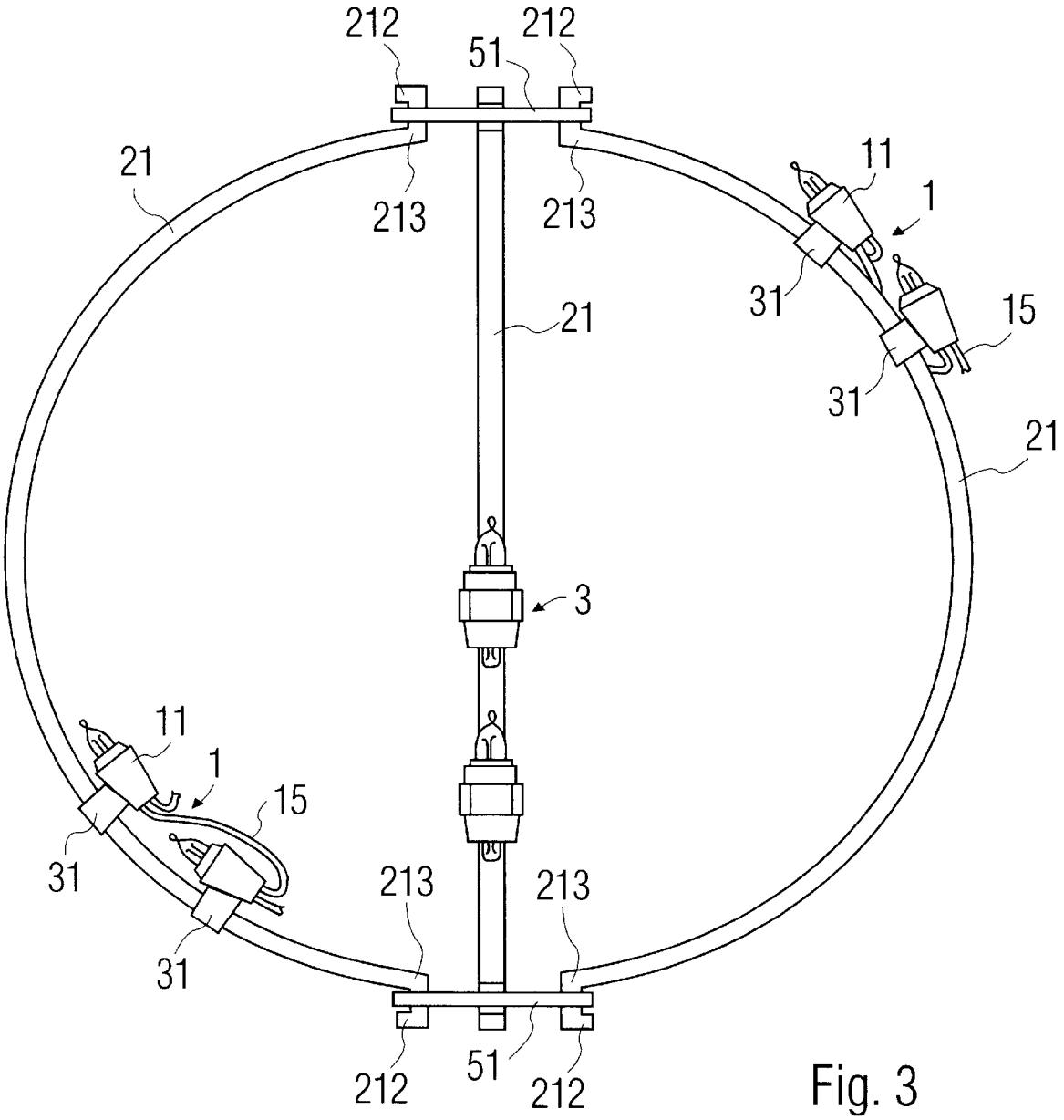
FIG. 3 is showing an expandable and shrinkable circle type of the decorative lighting string of the present invention.

FIGS. 2 and 3 show an exploded view of the second embodiment of the decorative lighting string of the present invention to depict the structure combination of the assemblies. The sideway of lamp holder 11 extends a clamping 31 so as to clamp the inner or out part of the half circle of stand. A rod 211 is formed between the ends 213 and the protruberance 212 of both ends of the half circle stand 21. There are various holes or openings on two axis plate 51 thereby the protruberance to pass through said holes or openings. Said rod 211 is filed in the holes or openings used as the axis. The half circle stand is able to rotate the direction and change the position. Or the circle and global decorative lighting string can be clamped by other support 3 to fixed on the stand.

Figure 4:
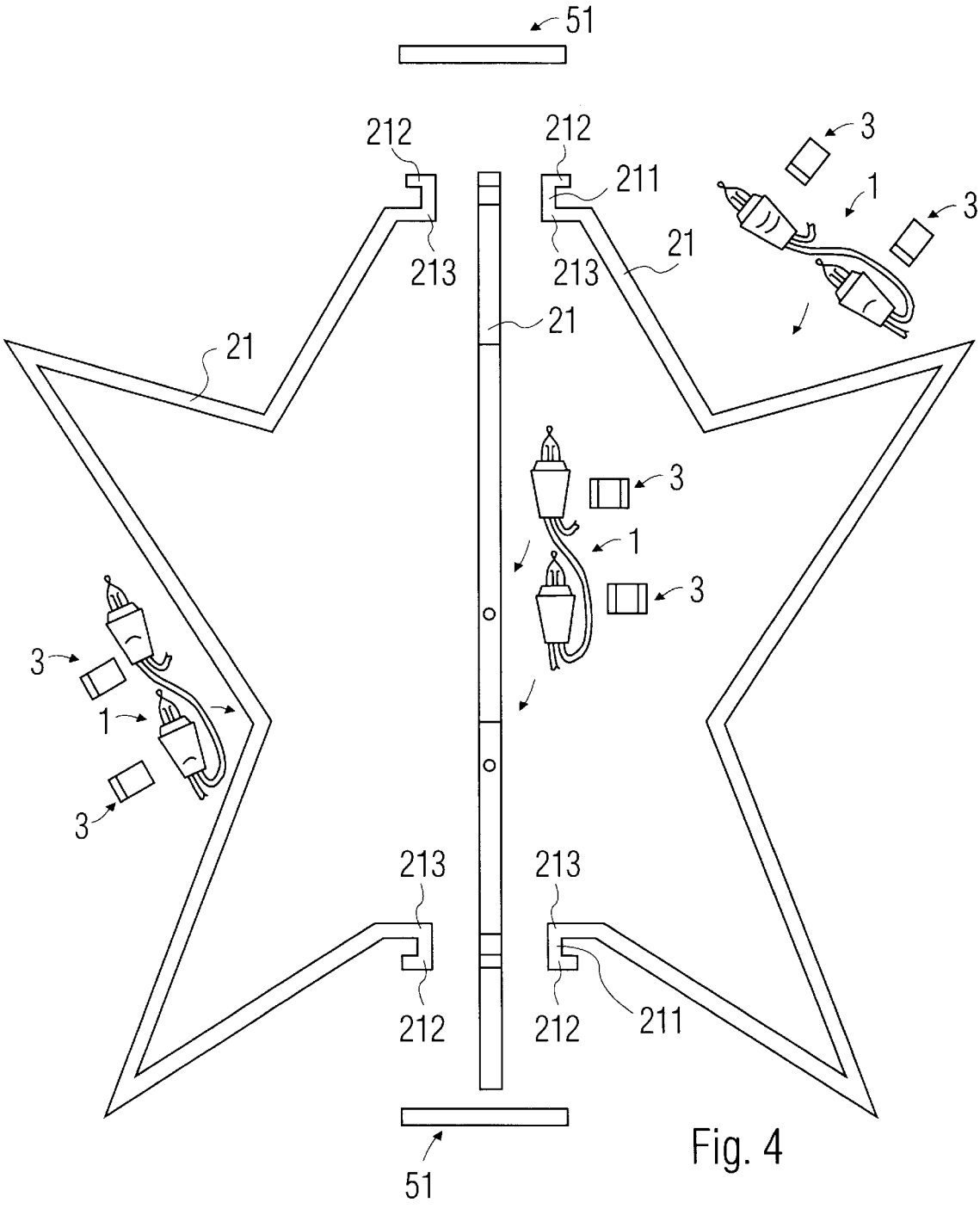
FIG. 4 is showing an exploded view of an expandable and shrinkable star type of the decorative lighting string of the present invention.
Figure 5:
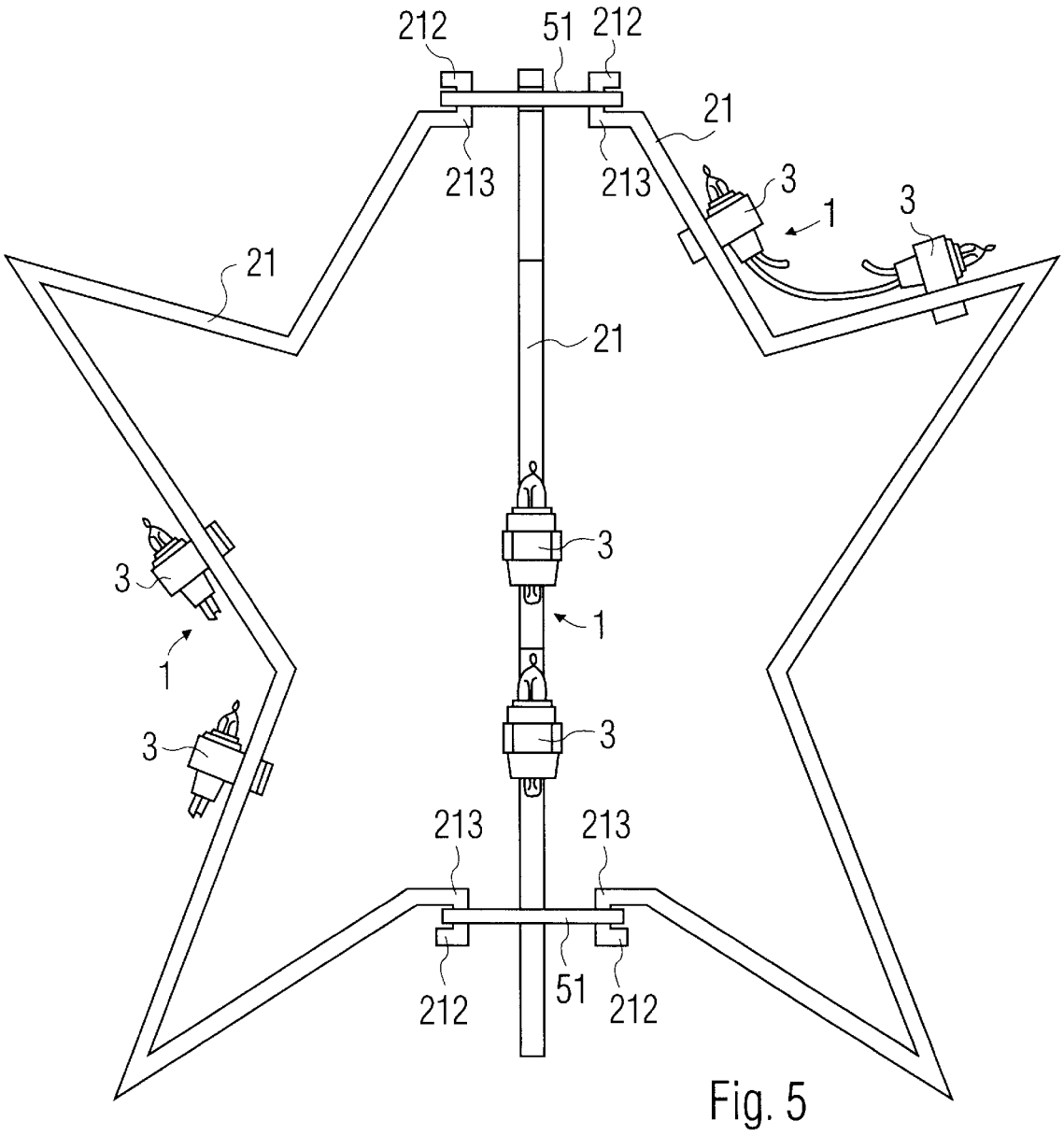
FIG. 5 is showing an expandable and shrinkable star type of the decorative lighting string of the present invention.

FIGS. 4 and 5 show an expandable and shrinkable polygon star type of the decorative lighting string of the present invention to depict of the third embodiment of the combination of the assemblies. The lighting string comprises the lamp bulb, lamp base or lamp holder formed by the connection of the electric wires. A clamping mean 3 is to clamp and fix the lighting string 1 on a stand 21. Said stand is a half polygon star. A rod 211 is formed between the ends 213 and the protruberance 212 of both ends of the half polygon star stand 21. There are various holes or openings on two axis plate 51 thereby the protruberance to pass through said holes or openings. Said rod 211 is filed in the holes or openings used as the axis. The half polygon star stand is able to rotate the direction and change the position to form the polygon star type of decorative lighting string.

Figure 6A:
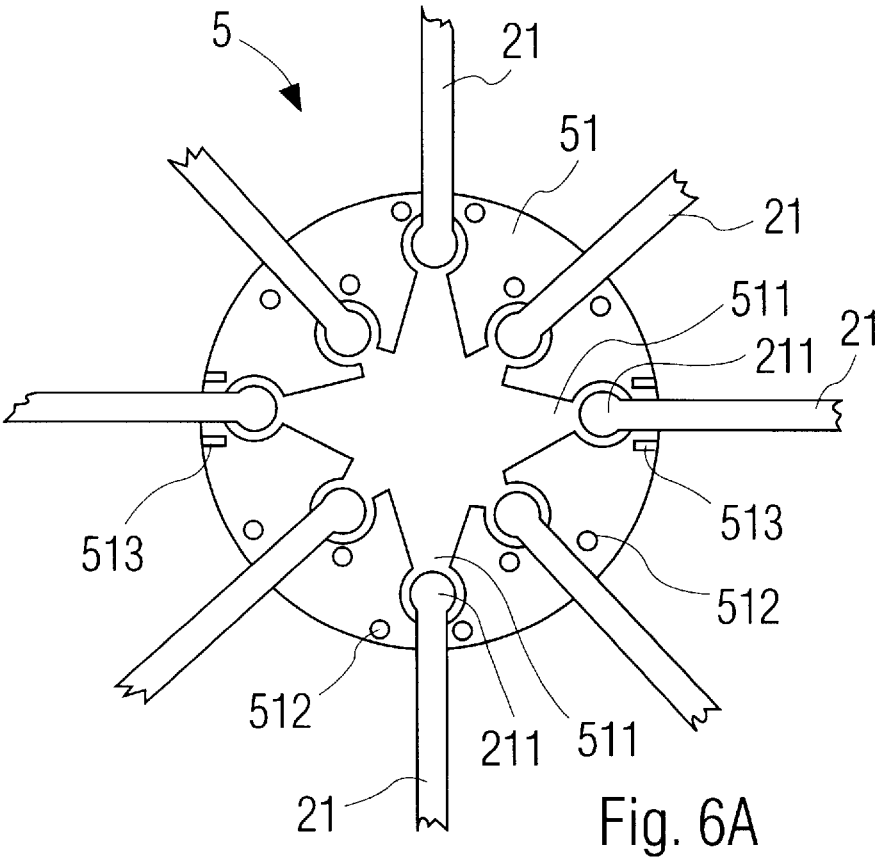
FIGS. 6A and 6B show the combination of axis mean plate and part of the stands of the decorative lighting string of the present invention, with FIG. 6A showing an expanded arrangement and with FIG. 6B showing a shrunken arrangement.
Figure 6B:
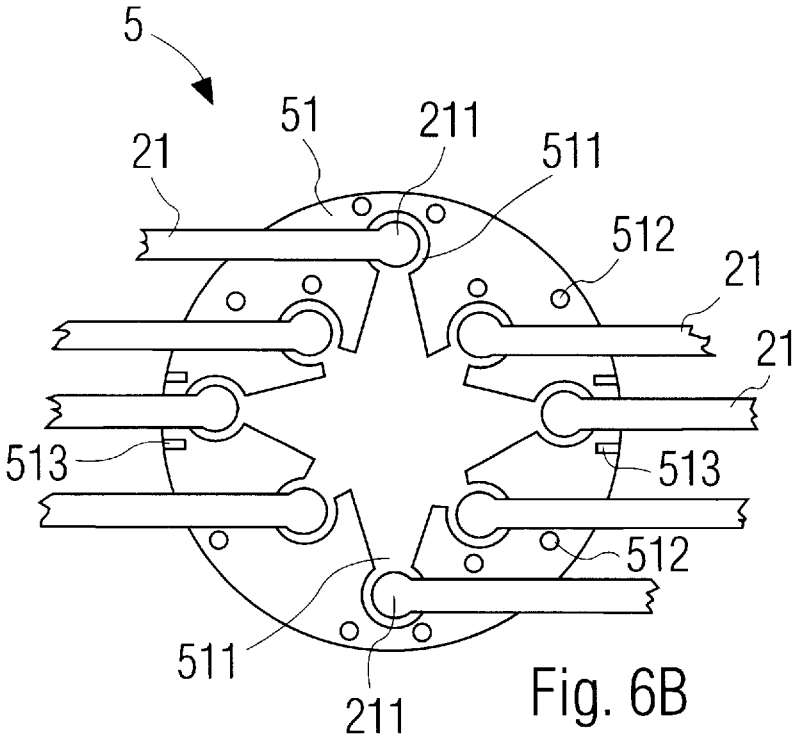

FIGS. 6A and 6B show the axis means 5 is to use the axis plate 51 having eight openings with hole 511. There are twelve circle protruberance 512 and four rectangular protruberance 513 on the axis plate 51. Eight stands 21 with rod 211 are used. While combinating, said rod 211 is pass through the hole 511 so as to form the axis. After expanding, the stands are limited to between two protruberances 512 or 513 as shown in FIG. 6A. While shrinking, the stands become parallel and the whole becomes flat as shown in FIG. 6B.

Figure 7A:
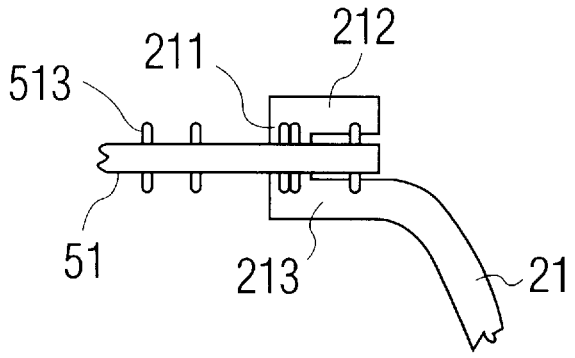
FIGS. 7A–7B show the combination of axis mean plate and part of the stands of the decorative lighting string of the present invention with FIG. 7A is showing the combination of a plate and stand, FIG. 7B showing a top view of the combination of plate and stand and FIG. 7C showing a bottom view of the combination of plate and stand.
Figure 7C:
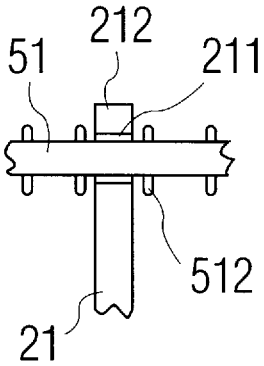
Figure 7B:
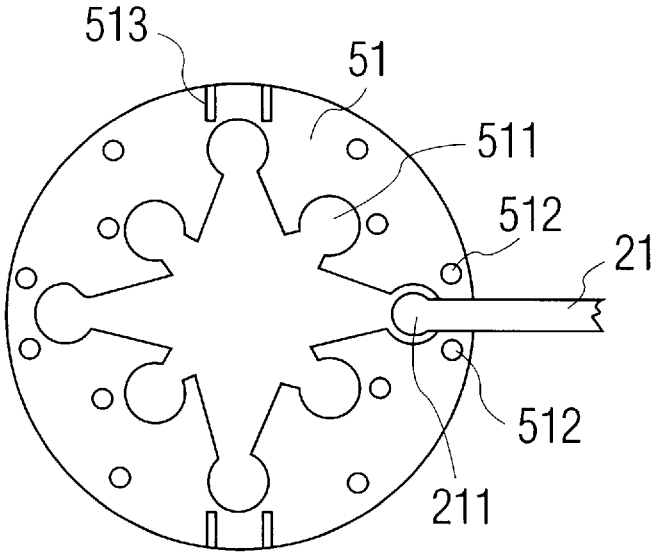

FIGS. 7A and 7B show the side view of part of FIGS. 6A–6B to depict the description of the structure more detailed. The axis plate 51 having eight openings with hole 511. There are twelve circle protruberance 512 and four rectangular protruberance 513 on the axis plate 51. The stands 21 with rod 211 and extending protruberance 213 are used and the stand 211 connected with the end 213 and rod 211 to for the right angle. The combination method and effect are same as the description in FIG. 6.

Figure 8A:
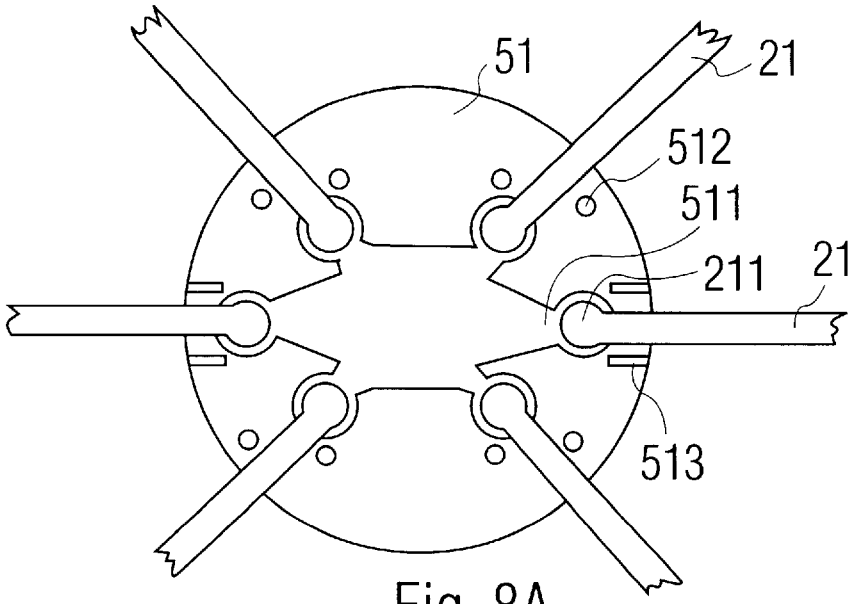
FIGS. 8A and 8B show a further embodiment of the combination of axis mean plate and part of the stands of the decorative lighting string of the present invention, with FIG. 8A showing an expanded arrangement, and with FIG. 8B showing a shrunken arrangement.
Figure 8B:
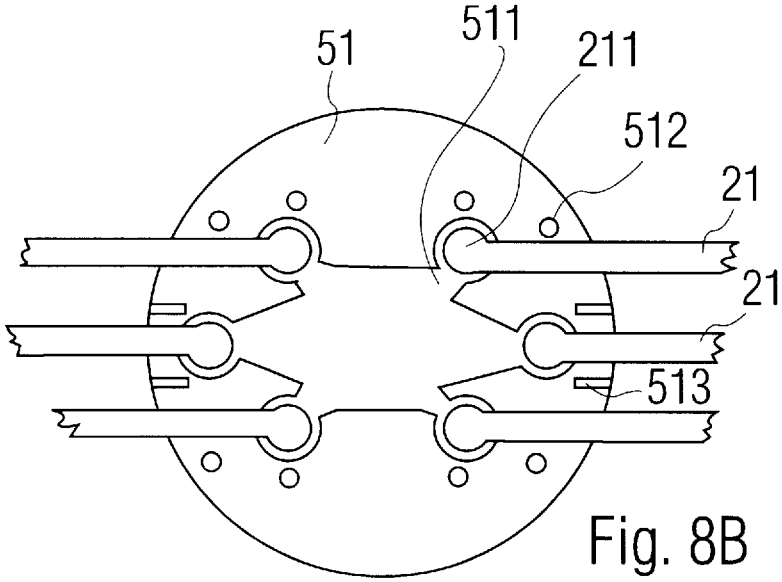

FIGS. 8A and 8B show the further embodiment of the present invention. While expanding, the structure of the combination of six stands and axis plate is same as shown in FIG. 8A. After shrinking, the structure is same as FIG. 8B. The combination method is identical with that of shown in FIGS. 6A–6B to use eight stands. Thus the detailed description is not done here.

FIGS. 9A, 9B and 9C show a three-dimensional rectangle type of the fourth embodiment of decorative lighting string of the present invention. The clamping means are used to clamp and fix the lighting string 1 and a kind of translucent plastic (or soft material) decorative sheet 42 on the four type stands 22. Both ends of each stands have hole 221. The axis material 52 has central part 521 and the protruberance 522 on both ends as the type of mushroom. Said central part 521 has straight protruberance or groove 523, the distance of protruberance on both ends is about four times of the depth of hole 221. While combinating, the axis passes through the hole 221, the stands 22 are overlap between the protruberance 522 on both ends and filled in the hole 221 of the central part 521. The protruberance or groove on the inner part of hole 221 are filled together. The said four stands 22 are to use axis 52 as center to change the position and direction so as to expand into rectangle decorative lighting string.

FIG. 10 shows the fifth embodiment of the lighting string. The lighting string comprises lamp bulbs 1*a,* 1*b,* 1*c* . . . , lamp holders 102*a,* 102*b* . . . , and another kind of lamp holder 13 connected with electric wires 15. Said lamp holders 102*a,* 102*b* . . . are clamped on the stands 2*a,* 2*b,* 2*e* . . . by using clamping material 3*a,* 3*b*. . . . The both ends of said stands have hole between stands 2*a* and 2*b,* 2*b* and 2*c,* 2*c* and 2*d* or 2*d* and 2*e,* and the lamp holder 13 passes through the holes 2*a* and 2*b* as axis so that each stands are able to used the lamp holder 13 as the center to change the position. Further, the stands 2*a,* 2*b,* 2*e* are the type, which each has hole 23 so as to make the wire 15 to pass through said hole 23 and received the different side of lamp bulb, i.e. from the top side, it is not easy to find the wire and not to destroy the beauty.

FIGS. 11A and 11B show a structure of using a kind of lamp holder 13. There is a ring protruberance 131 on the waist of said lamp holder 13, and the stand has hole, rod and hook to be filled together. In FIG. 11A, the stand 231 has hold 231*a* and rod 231*b* beside said hole, a hook 231*c* on said rod. Another stand 232 has hold 232*a* and 232*b,* said lamp holder 13 passes through said hole 231*a* and 232*a.* The hook 231*c* on the rod 231*b* passes another hole 232*b,* said hook 231*c* to fix the protruberance 131 so as not to drop away. Said lamp holder 13 uses as the axis to make the two stands 231 and 232 move their position and direction. In FIG. 11B, the stand 233 has hole 233*a,* rod 233*b,* hook 223, another hook 233*d,* and another stand 234 has hole 234*a,* rod 234*b,* hook 234*c,* another hole 234*d.* The two stands are to use hook 233*c,* 234*c,* rod 233*d,* 234*d* to pass through the holes 234*d* and 233*d* of another stand, using the hook to fix together with another stand, lamp holder passing through the holes 233*a* and 234*a* of two stands to make the protruberance 131 be fixed between two stands. Said lamp holder 13 uses as the axis to make the two stands 233 and 234 move their position and direction.

FIGS. 12A, 12B, 12C and 12D show a structure of using a kind of axis material as ring axis. Each lighting string 1 clamps on each stands 2 by using clamping material. One end of each stand 2 has hole or opening 24, the ring axis 54 passing through each hole or opening 24. The another end of stand 2 is connected to the lines which can be bent or sheet material 44. As shown in drawing, one end of each four stands is connected by a ring axis. Another end is connected to the line with same length and the ring axis 54 is the center. One end of each four stands is able to move its position or direction, said four lines with same length limit to the width of movement so as to expand as the decorative lighting string of pyramid shown in FIGS. 12A and 12B. While shrinking, as shown in FIG. 12C, the volume becomes very small and shrinkable decorative lighting string.

FIGS. 13A, 13B and 13C show a global lantern type of the seventh embodiment of decorative lighting string of the present invention. The axis mean uses as the stand having support, hole or opening. The global lantern type lighting string 1 is using the clamping means to clamp on the circle stand 251, 252, 253 . . . , said circle stands have another stands 251*a,* 251*b,* 252*a,* 252*b* . . . and connected to the axis means 55. Among the another stands, the axis means use as the axis, which is able to bend or to be expandable. When the multiple circle stands are expandable, the decorative lighting string becomes a global lantern as shown in FIGS. 13A and 13B. After the axis means 55 being bent, said lighting string is shrinkable and becomes a fan type as shown in FIG. 13C.

FIGS. 14A and 14B show a cross type of the eighth embodiment of decorative lighting string of the present invention. The axis mean uses as the stand having support, hole or opening. The cross type lighting string 1 is using the clamping means to clamp on the multiple stand. The end of each stands is connected with axis means, said axis means being used as axis. When bending or expanding, the multiple stands are expanded into a solid cross type lighting string. After the axis means 55 being bent, said lighting string becomes the drawing as shown in FIG. 14B. Thus the volume is smaller than original one.

FIGS. 15A, 15B, 15C and 15D show a structure of using a kind of axis means as stand and individually or simultaneously having a support, hole or opening. The end of stand has a support 21 having a protruberance 211 as the type of mushroom. There is protruberance or groove 212 on the support. Further, the end of said support 21 has the hole 221, and there is protruberance or groove 222 in the hole. When the support 21 passes through the hole 221, the protruberance 211 on the support connected to another stand and fixed steadily not to drop off, said protruberance or groove 212, 222 matches the support to fix the position and direction. FIGS. 15A and 15B are the stands not yet combinated. FIGS. 15C and 15D are the stands being combination, support 21 uses as axis, it can be rotated so as to bend the stand.

FIG. 16 shows the ninth embodiment of the lighting string. The relating position of the assemblies of stand and axis means are put together. The lamp bulbs 1*a,* 1*b,* 1*c* . . . and lamp holders are connected with electric wires to form the lighting string 1. The cross-section of stand 2 is about the rectangle having protruberance 201*a,* 201*b,* 202*a,* 202*b* . . . , the clamping mean 3 being a single U type, two feet extended from its base 31 to bend toward inside and inner part having protruberance 302*a,* 302*b* . . . , said clamping means being used to clamp the inner part of base 31 to the stand 2, the protruberance 302*a,* 302*b* . . . being used to fix their position, then to clamp the lamp holder within the opening part of the two feet which bent toward inside.

FIG. 17 shows the another embodiment of the lighting string. The relating position of the assemblies of stand and axis means are put together. The lamp bulbs, and lamp holders are connected with electric wires to form the lighting string 1. The clamping mean 3 being a double U type, two pair of feet 3*a,* 3*b* extended from its base 32, said clamping means being used to clamp the inner part of base 32 of the stand 2, then to clamp the lamp holder within the opening part of the two feet which bent toward inside.

FIG. 18 shows the relating position of the lighting string, stand, decorative material and clamping means of the present invention. The lamp bulb 1*a,* 1*b,* 1*c* . . . and lamp holder 102*a,* 102*b,* 102*c* . . . are connected with the electric wire to form a lighting string 1. The decorative material 4 has rod part 45, stand 2 having support 201, groove 200*a,* 200*b* and the clamping means 3 being a single U type, two feet extended from its base 33 to bend toward inside and central part of base having hole 301. Two feet of the clamping means 3 put into the groove 200*a,* 200*b* of stand 2, the support 201 passing through said hole 301. After combination together, it is stable and not easy to move, then to clamp and fix the rod part 45 of the decorative material 4 between the lamp holder and stand.

FIG. 19 shows the further embodiment of the relating position of the lighting string, stand, decorative material and clamping means of the present invention. The lamp bulb 1*a,* 1*b,* 1*c* . . . and lamp holder 102*a,* 102*b,* 102*c* . . . are connected with the electric wire to form a lighting string 1. The stand 2 has the protruberance 201*a,* 201*b,* 202*a,* 202*b* . . . , the clamping means 3 is a single U type, two feet extended from its base 34 to bend toward inside and inner part having protruberance 302*a,* 302*b* . . . , opening 311*a,* 311*b*. Two feet of the clamping means 3 put into lamp holder 102*a,* the protruberance 302*a,* 302*b* are used to fix the position, then to fix into the protruberance 201*a,* 201*b,* 202*a,* 202*b* of the stand. The opening 311*a,* 311*b* are used to fix the position so as to prevent the stand and lighting string from moving.

FIGS. 20A, 20B and 20C show the combination method for the relating position of the lighting string, stand, decorative material and clamping feet extending from the lamp holder of the present invention. The lamp holder 10 is used, the outer part 121 of the waist of said lamp holder extended the feet 122, the inner part of the feet having protruberance 123, the outer part of fee having a hook 124 and an inclined plane 125 toward the inside, or a hook 126 and an inclined plane 127 toward outside, a wire 15 being stretched out. Further, said stand 2 has an inclined plane 27 or hole 26, and the decorative sheet 4 has a hole 46. In FIG. 20A, the lamp holder has two feet 122 to clamp wire 15, then to clamp stand 2, the protruberance 123 and the hook 125 being fixed tightly with the inclined plane 27 of stand 2 and the inclined plane 125 of hook 124 so as to convenience of combination. In FIG. 20B, the lamp holder has two feet 122 to clamp wire 15, then to pass through the hole 46 of the decorative sheet 4, and then to clamp stand 2, the protruberance 123 and the hook 125 being fixed tightly. In FIG. 20C, the lamp holder has two feet 122 to clamp wire 15, then to pass through the hole 46 of the decorative sheet 4, and then to pass through the hole 26 of the stand, so that the protruberance 123 and the hook 126 being fixed tightly. The inclined plane 127 is used for the convenience of combination as shown in the FIGS. 2 and 3.

FIGS. 21A and 21B show the various combination method relating to the lamp holder, decorative material, stand and clamping means of the present invention. The lighting string 1 is used, the decorative sheet 4 having hole 46, and stand 2 having hole 26. The clamping mean 3 has two feet extended from the base 34, said feet having the inner protruberance 302*a,* 302*b,* opening 311*a,* 311*b* toward inside. In FIG. 21A, two feet of clamping mean 3 are passing through the hole 26 of stand to fix the protruberance 302*a,* 302*b,* then to clamp the wire and lamp holder so that the opening 311*a,* 311*b* which toward inside are fixed tightly. In FIG. 21B, two feet of clamping mean 3 clamp the about the rectangle stand 2, which being fixed tightly by using the protruberance 302*a,* 302*b,* then to pass through the hole 46 of the decorative sheet 4, and then to clamp the wire and lamp holder to be fixed tightly within the opening 311*a,* 311*b,* as the combination shown in FIGS. 16 or 18.

FIGS. 22A and 22B show the combination method relating the lamp holder, decorative material, stand and clamping means of the present invention. The lighting string 1 is used, the decorative sheet 4 having hole 46, stand 2 having hole 26, two feet extended from the base 34 of the clamping mean 3 to be bent toward inside and inner part having protruberance 351, a hook 352 and an inclined plane 353, 354 toward outside, or a hook 355 and an inclined plane 356 toward inside. In FIG. 22A, clamping mean 3 is used to clamp the lamp holder or wire near the position of base 35, two feet pass through the hole 26 of stand 2, the prtruberance 351 and the hook 352 being fixed tightly, said inclined plane 353 and 354 being the convenience of combination. In FIG. 22B, clamping mean 3 is used to clamp the lamp holder or wire near the position of base 35, two feet pass through the hole 46 of decorative sheet 4, then to clamp stand 2, the prtruberance 351 and the hook 355 being fixed tightly, said inclined plane 356 being the convenience of combination, as the combinated structure shown in FIGS. 4, 5 and 19.

FIGS. 23A and 23B show the combination method relating the lamp holder, stand and clamping means of the present invention. The lighting string is to use lamp bulb 1, the lamp holder 10 is connected by the wire 15. The used stand 2 with type has hole 23 and 27, protruberance 28. The clamping mean is a kind of clamping mean 36 having two feet with a hook 352 toward outside, another kind of clamping mean 37 having two feet with hook 355 toward inside. The clamping mean 36 is used to clamp the lamp holder 10, two feet passing through the hole 27 to be fixed tightly by hook 352. On the stand, the clamping mean 37 is to clamp the lamp holder 10, two feet passing through the hole 27, and to be fixed tightly on the stand by using hook 355. The wire 15 passes through the hole 23 and received in the stand with type, the protruberance 28 being used to support or fix said wire, so that from the bulb side, it is not easy to find the wire. Further, part of lamp holder 37 is also buried in the stand with type, as the combination structure shown in FIG. 10.

The features and preferred embodiments of the present invention have been described in the foregoing specification. The invention intended to be protected herein, however, is not to be constructed as limited to the particular forms disclosed. Variations and changes which may be made by those skilled in the art are without departing from the scope of the present invention.

What is claimed is:

1. An expandable and shrinkable decorative lighting string arrangement, comprising:

a plurality of lamp bulbs, lamp bases, lamp holders, connected by wires to form a lighting string;

a plurality of stands;

multiple clamping means for fixing said lighting string on one of said stands; and single or multiple axis means forming a support for ends of said stands whereby each of said stands is movable to change a position of each stand by movement in a direction, said single or multiple axis means cooperating with said stands forming an expandable and shrinkable volume or pattern so as to obtain a decorative structure having an expanded volume and a shrunken volume with said stands disposed adjacent to each other, said axis means including locking means for locking said stands to said axis means to form said expandable structure.

2. The decorative lighting string unit according to claim 1, wherein said clamping means comprises multiple feet extending from a base to form a channel, said channel being clamped around and fixed to said stand and one of said lamp base or lamp holder, said axis means forming a three-dimensional structure.

3. The decorative lighting string unit according to claim 1, wherein:

said clamping means including multiple feet extending sideways from the lamp base or lamp holder, two feet of said multiple feet being clamping and fixing the stand, the lamp base or lamp holder fixed on the stand, said axis means connected to each stand to form a three-dimensional structure for decorative lighting string.

4. The decorative lighting string unit according to claim 3, wherein:

said clamping means has clamping feet defining a U shaped channel.

5. The decorative lighting string unit according to claim 1, wherein:

said clamping means includes two feet extending from a base to form a channel clamping the stand on the base and also clamping the lamp base or lamp holder near said channel.

6. The decorative lighting string unit according to claim 1, wherein:

said clamping means includes two feet extending from a base to form a channel clamping the lamp base or lamp holder on the base and also clamping the stand near said channel.

7. The decorative lighting string unit according to claims 2 or 3, wherein the clamping means includes two clamping feet, said clamping feet having an inside protuberance or book toward inside so as to clamp and fix the stand within the opening between said two feet.

8. The decorative lighting string unit according to claims 2 or 3, wherein the clamping means includes two clamping feet, said clamping feet having a protuberance or hook on an outer side so as to clamp and fix the stand within the opening between two feet.

9. The decorative lighting string unit according to claims 2 or 3, wherein the clamping means includes two clamping feet, the inner part or outer part of said clamping feet having a protuberance or inclined angle about the stand so as not to drop off.

10. The decorative lighting string unit according to claims 2 or 3, wherein the clamping means includes two clamping feet, one of the inner part or outer part or a protuberance of said clamping feet being inclined for convenience of combination.

11. The decorative lighting string unit according to claims 2 or 3, wherein:

each of said stands has one of a protuberance, support, hole or opening, said clamping means has one of a hole or opening, support or protuberance, said clamping means being fixed to one of said stands by a respective one of said protuberance or support and hole or opening.

12. The decorative lighting string unit according to claims 2 or 3, wherein:

said stands have a extended sheet to form a word or a picture.

13. The decorative lighting string unit according to claims 2 or 3, wherein:

said each stand is a straight sheet with a cross-section being one of a rectangle or polygon between said feet said clamping means, said clamping means and said stand being fixed together so as not to move.

14. The decorative lighting string unit according to claims 2 or 3, wherein:

said each stand being a sheet having several holes or openings, the feet of said clamping means being fixed and clamped to an edge of said hole or opening.

15. The decorative lighting string unit according to claim 14, wherein:

said each the used sheet stand have a protruberance, support, hole or opening to make the part or all of wire, lamp base or lamp holder fixed in said protruberance, support, hole or opening so as to receive in the stand opposite side of the lamp bulb.

16. The decorative lighting string unit according to claims 2 or 3, wherein:

said each stand having several holes or openings, the feet of said clamping means being fixed and clamped to an edge of said hole or opening.

17. The decorative lighting string unit according to claim 16, wherein:

said each stand has a protruberance, support, hole or opening to make the part or all of wire, lamp base or lamp holder fixed in said protruberance, support, hole or opening so as to receive in the stand opposite side of the lamp bulb.

18. The decorative lighting string unit according to claim 1, wherein the used clamping mean having several feet extended from the base, besides to clamp the stand, lamp base or lamp holder, being further to clamp decorative material between the clamping mean and stand, or between the stand and lamp base or lamp holder.

19. The decorative lighting string unit according to claim 1, wherein:

said clamping means clamps decorative material formed as a sheet, said sheet decoration having single or multiple holes, the feet of said clamping means being passed through whereby to be fixed.

20. The decorative lighting string unit according to claim 19, wherein:

said sheet for decorative material is transparent, semi-transparent or opaque, said sheet being extended to form a word or a picture so as to strengthen a decoration effect.

21. The decorative lighting string unit according to claims 1 or 18, wherein:

said clamping means clamps material in a form of a rod or sheet.

22. The decorative lighting string unit according to claim 1, wherein:

said axis means includes an axis plate with several holes or openings, the end of said stands having a rod part, several rod parts of said stands being individually passed through said holes or openings to be connected to said axis plate, each of said rod parts being a center to rotate the stands to form the decorative lighting string into a changeable volume or pattern.

23. The decorative lighting string unit according to claim 1, wherein:

an inner part of said axis means defines openings, a circumference of said axis means includes protuberances or grooves, after combination of said stands with said openings, the protuberances or grooves fix the position and direction of said stands.

24. The decorative lighting string unit according to claim 1, wherein said axis means has an axis part, said stands have a hole, said axis part passes through said hole to connect said stands, the axis part being a center to rotate the stands to form a decorative lighting string with a changeable volume or pattern.

25. The decorative lighting string unit according to claim 24, wherein a circumference of said axis part and an inner part of the hole of said stands have a protuberance or groove, after combination of said axis means and said stands, the protuberances and grooves are fixed together so as to fix the position and direction of said stands.

26. The decorative lighting string unit according to claim 24, wherein ends of said axis part have a protuberance, a distance between said protuberances being a combined thickness of said stands.

27. The decorative lighting string unit according to claims 22 or 24, wherein two said axis means are used, said stands being shaped as a half circle and both of ends of said stands having a rod part or hole, after combination of said two axis means with the stands, the stands are able to be rotated and expanded to obtain a global lighting shape.

28. The decorative lighting string unit according to claim 27, wherein said clamping means clamps a sheet to obtain a global pumpkin type decorative lighting shape.

29. The decorative lighting string unit according to claims 22 or 24, wherein two axis means are used, said stands being a half polygon star and ends of said stands having a rod part or bole, after combination of said axis means and said stands, said stands being able to be rotated and expanded to obtain a polygon star type of lighting shape.

30. The decorative lighting string unit according to claim 1, wherein:

one of said lamp holders is used as an axis of said axis means;

said multiple stands define holes;

said one lamp holder is fixed and connected to the hole of one of said stands.

31. The decorative lighting string unit according to claim 1, wherein: one of said lamp holders includes a protuberance on a waist of said lamp holder;

said plurality of stands define a hole and including a support and hook, said hook fixing the protuberance of said one holder, said one lamp holder being a center to rotate the stands.

32. The decorative lighting string unit according to claim 31, wherein:

said hook fixes another said stand and the protuberance of lamp holder to cause said protuberance to be clamped tightly between two said stands.

33. An expandable and shrinkable unit for a decorative lighting string comprising several lamp bulbs, lamp bases, lamp holders, connected by wires to form a lighting string, multiple stands, sheet material, multiple clamping means and a single or multiple axis mean, each clamping means clamping sheet material to each stand, said clamping means being to clamp or fix the lamp base or lamp holder, an axis means connected to each stand, said axis means being used as a center, each stand being able to change a position thus forming an expandable and shrinkable volume so as to obtain a kind of decorative structure.

34. The decorative lighting string unit according to claim 33, wherein the stand or sheet material is extended to form a word or a picture.

35. An expandable and shrinkable decorative lighting string arrangement, comprising:

a plurality of lamp bulbs, lamp bases, lamp holders, connected by wires to form a lighting string;

a plurality of stands, each of said stands including an end;

multiple clamping means for fixing said lighting string on one of said stands;

axis means forming a support for said ends of said stands, said axis means being movably connected to said ends to change a position of said stands relative to said axis means to form both an expandable and shrunken volume, said expandable volume attaining a decorative structure with said stands spaced from each other, and said shrunken volume having said stands disposed adjacent to each other, said axis means including locking means for locking said stands to said axis means in positions forming said decorative structure.

* * * * *